US005779500A

United States Patent [19]

Tokuwa et al.

[11] Patent Number: 5,779,500

[45] Date of Patent: Jul. 14, 1998

[54] SNAP-FIT CONNECTOR

[75] Inventors: Koichiro Tokuwa; Hitoshi Okumura, both of Mie, Japan

[73] Assignee: Sumitomo Wiring Systems, Ltd.

[21] Appl. No.: 639,090

[22] Filed: Apr. 24, 1996

[30] Foreign Application Priority Data

Apr. 24, 1995 [JP] Japan ..... 7-124440

[51] Int. Cl.[6] ..... H01R 13/74

[52] U.S. Cl. ..... 439/557; 439/562; 439/565; 439/544

[58] Field of Search ..... 439/544, 557, 439/562, 565, 571

[56] References Cited

U.S. PATENT DOCUMENTS

| | | | |
|---|---|---|---|
| 2,744,769 | 5/1956 | Roeder et al. | 439/557 |
| 3,115,308 | 12/1963 | Stark | 439/557 |
| 3,183,297 | 5/1965 | Curtiss | 439/557 |
| 3,354,422 | 11/1967 | Duris | 439/557 |
| 4,717,358 | 1/1988 | Chaundy | 439/557 |
| 5,302,140 | 4/1994 | Arnett | 439/557 |

*Primary Examiner*—J. J. Swann
*Attorney, Agent, or Firm*—Banner & Witcoff, Ltd.

[57] ABSTRACT

A hood member 12 of a snap-fit male electrical connector 10 is inserted and retained in a through hole 21 of a panel 20. A locking arm 15, having a resilient retaining claw 16 is provided on the peripheral wall face of the hood member 12. A guard 17 is formed in front of the stopping claw 16, so that even if a female connector 30 is pushed diagonally and makes contact with the guard 17, the locking arm 15 is prevented from being bent downwards, thereby accidentally releasing the connector 10 from the through hole 21.

11 Claims, 5 Drawing Sheets

SNAP-FIT CONNECTOR

FIELD INDUSTRIAL APPLICATION

The present invention relates to a fixed-type connector, and more particularly to a fixed-type electrical connector which is supported by retaining a hood member in a through hole formed in a panel or the like.

PRIOR ART

FIGS. 4 and 5 show an example of a conventional fixed-type connector.

In the diagrams, a male connector 1 has a hood member 2 formed thereon. On the peripheral wall of the upper face of the hood member 2 (as viewed) are formed cuts or slits 2*a* that extend in a parallel manner from the open end inwardly. Between the slits 2*a* is formed a locking arm 2*b*. The upper face of the outer extremity of the locking arm 2*b* has a wedge-shaped stopping claw 2*b*1. On the peripheral wall of the lower face of the hood member 2 is formed one or more projections 2*d* (FIG. 5) in a position corresponding to the stopping claw 2*b*1. Furthermore, an outwardly extending flange 2*c* is formed around the external circumference of the hood member 2 a little inwardly of the stopping claw 2*b*1 and the projection.

A panel 3 has a through hole 3*a* formed thereon so as to correspond to the outer shape of the hood member 2. The hood member 2 is inserted from the inner side of the panel 3 and is retained therein. In practice, the male connector 1 is entered at an angle and the edge of the through hole 3*a* is fitted into the groove between the lower end of the flange 2*c* and the projections 2*d*. Then the male connector 1 is gradually brought upright until the upper end of the hood member 2 enters the through hole 3*a*, and the wedgeshaped fitting claw 2*b*1 makes contact with the edge of the through hole 3*a*. The locking arm 2*b* is pushed under and across the edge of the through hole 3*a* to form a snap-fitting. After the locking arm 2*b* is latched, the projection and the fitting claw 2*b*1 are located on the outer side face of the panel 3 and the flange 2*c* presses against the inner side face of the panel 3. The male connector 1 is thereby retained at the edge of the through hole 3*a* of the panel 3 so as to fit snugly therewith.

Thereafter, a female connector 4 that can be inserted and thereby connected to the hood member 2 is pressed into and connected to the hood member 2 from the outer side of the panel 3.

During the operation whereby the female connector 4 is connected, there is no problem in insertion if the through hole 3*a* of the panel 3 is in a visible position. However, if the through hole 3*a* of the panel 3 is not in a visible position, the operator must first find the opening of the hood member 2 by moving around a hand or the female connector 4 in the vicinity of the male connector. At this juncture, since the insertion is carried out by first searching for the opening of the hood member 2, there is a possibility of the male connector 1 becoming separated from the panel 3. As shown for example in FIG. 5, the angular portion of the outer extremity of the female connector 4 can strike against the protruding end of the locking arm 2*b*, and the locking arm 2*b* may be bent downwards thereby separating the male connector 1 from the panel 3. When this happens, the entire operation must be repeated right from carrying out the attachment of the male connector 1. This is a great waste of effort, and may be extremely difficult if access to the rear of the panel 3 is restricted.

The present invention has been developed after taking into consideration the above problem and aims at presenting a fixed-type connector wherein the locking arm cannot be accidentally released and separated from the panel even in the case where the through hole 3a of the panel 3 is not in a visible position.

SUMMARY OF THE INVENTION

According to the invention there is provided a snap-fit connector for retention in an aperture of a panel, the connector having a resilient locking arm engageable with the edge of said aperture wherein a guard is provided at the free end of the locking arm.

According to this invention the necessarily free outer end of the locking arm is protected by the guard so that attempted attachment of the corresponding connector cannot accidentally release the locking arm by contact therewith.

Preferably the guard surrounds the locking arm. This arrangement is advantageously moulded in plastic materials, and increases the strength of the connector since guard does not have a free end.

In a preferred embodiment the connector has a protruding hood, the locking arm being co-extensive therewith, and said hood constituting said guard.

Preferably the hood is inclined inwardly so that the internal dimension thereof decreases progressively towards the outer edge. In this way the locking arm can make contact with the edge portion smoothly and at the desired angle since the inclined face of the hood or guard makes contact with the edge portion of the aperture and guides entry before the locking arm makes contact with the inner edge of the aperture. If the guard were not present the locking arm could make abrupt contact at a significant angle and there would be a possibility of it being damaged, but with the inclined face guiding the insertion, damage to the locking arm can be prevented.

In a preferred embodiment a fixed structure constituting a stop member is formed on a side on the hood member opposite to the side having the locking arm, the stop member co-operating with the stop flange to engage the inner edge of said aperture.

This arrangement is advantageous since damage to the locking arm can be prevented; the connector is inserted by pivoting about the clearance between the stop member and the stop flange, which ensures a guided insertion path.

BRIEF DESCRIPTION OF DRAWINGS

Other features of the invention will be apparent from the following description of a preferred embodiment shown by way of example only in the accompanying drawing in which.

DESCRIPTION OF PREFERRED EMBODIMENT

Figure 1:
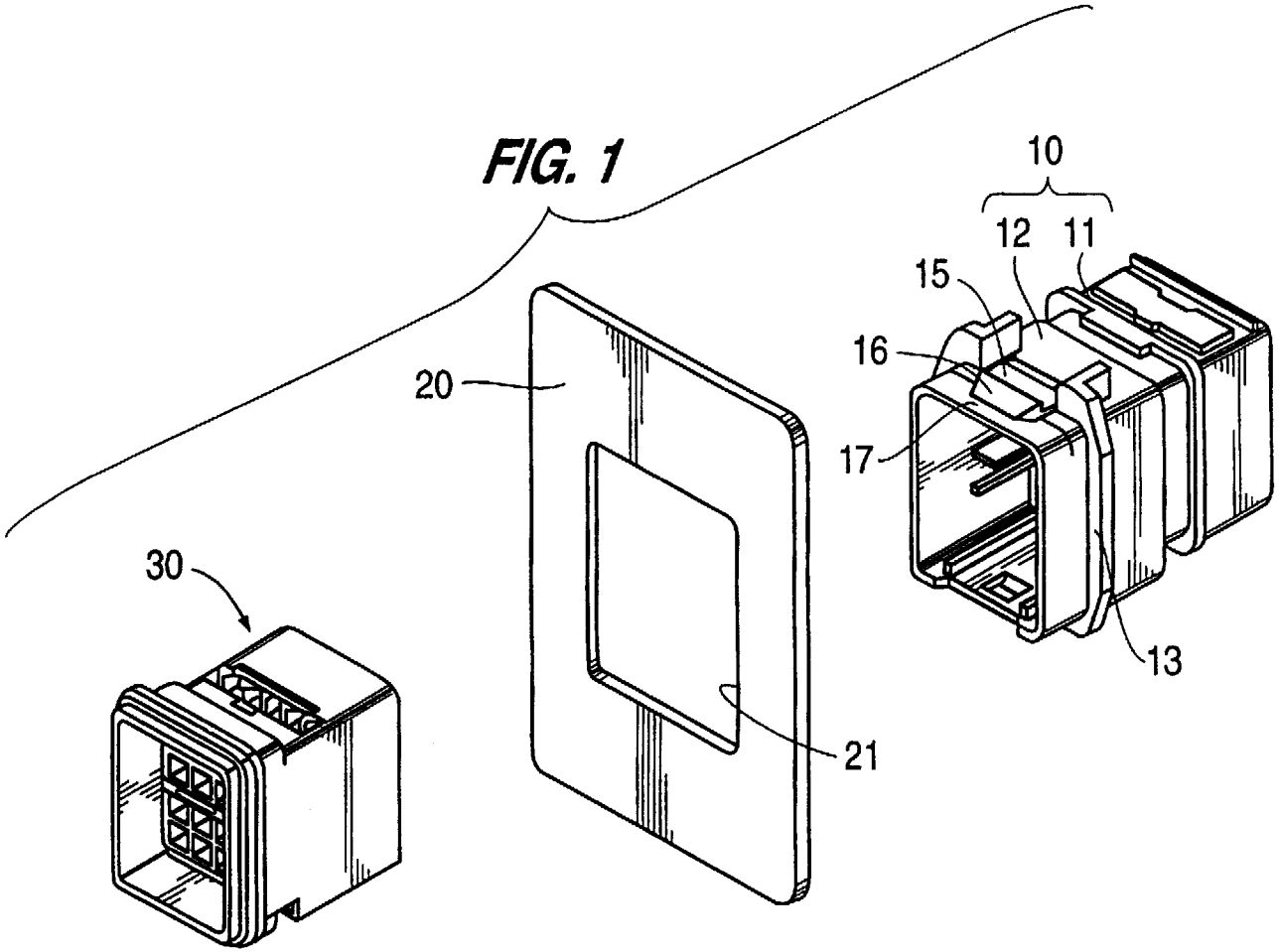
FIG. 1 is an exploded isometric view of components illustrating the present invention.
Figure 2:
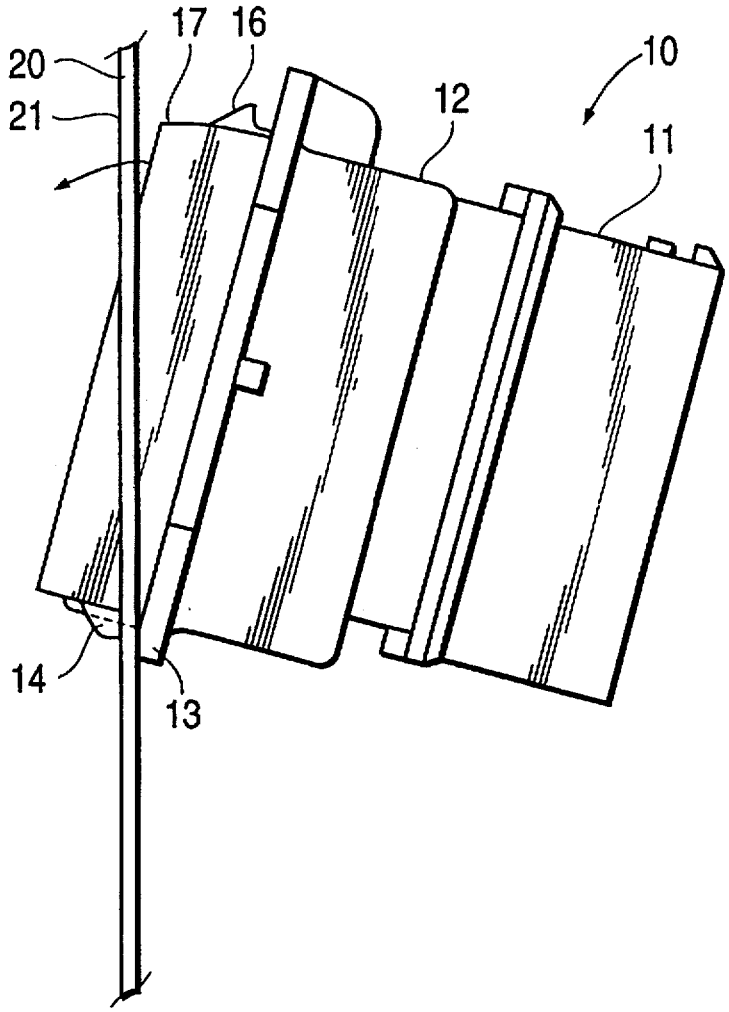
FIG. 2 is a side view showing the attachment process of the male connector.
Figure 3:
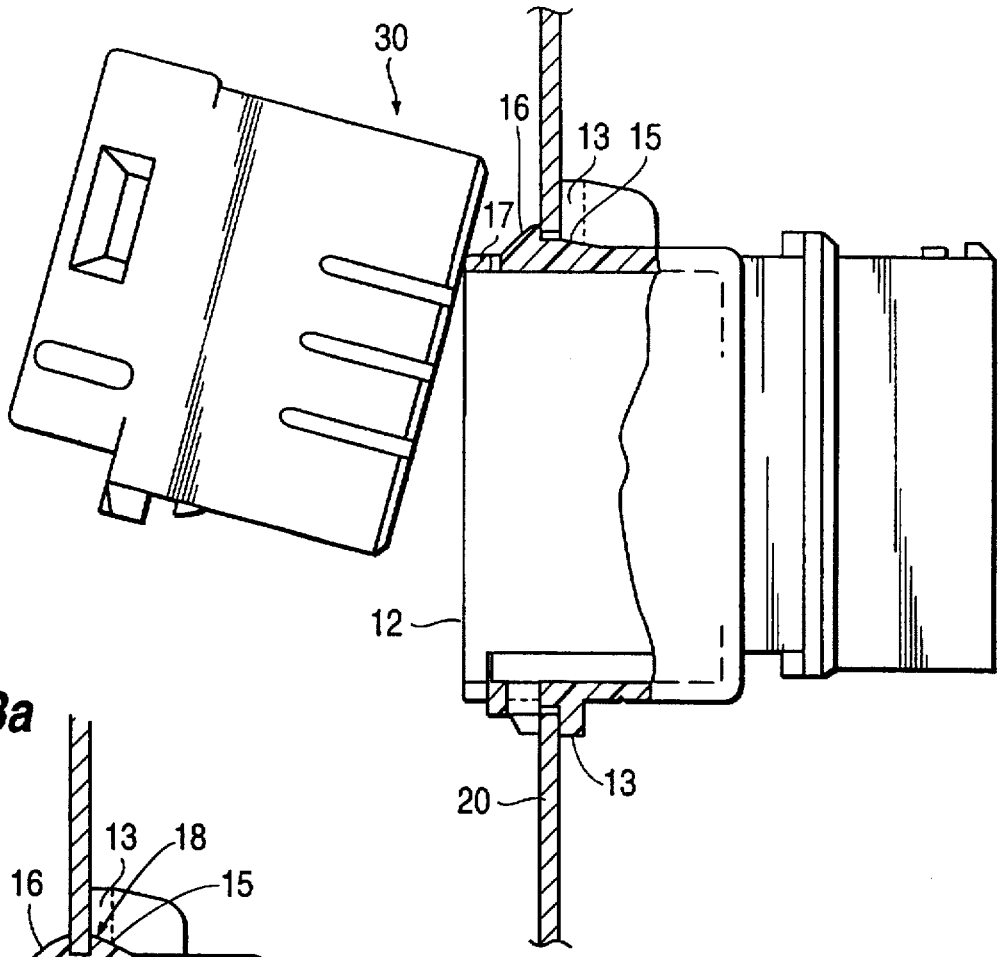
FIG. 3 is a partial cross-section showing the female connector making contact with the male connector.

With reference to FIGS. 1–3, a male connector 10 constitutes a snap-fit type of connector and comprises a housing 11, typically moulded of plastic, that houses and supports male terminal fittings (not shown) and a hood member 12 that extends from the edge of the housing 11 and is formed in a hood shape and surrounds the male terminal fittings. The hood member 12 of the male connector 10 is insertable into a through hole 21 formed in a panel 20. When the hood member 12 is inserted into the panel through hole 21, an approximately ring-shaped flange 13 formed on the outer circumference of the open side of the hood member 12 fits against the inner side face of the panel 20. The flange 13 need not be continuous.

Furthermore, on the lower face of the hood member 12 a stop projection 14 is formed so as to be separated from the flange 13 only to the extent of the thickness of the panel 20. The upper face of the peripheral wall of the hood member 12 includes a U shaped cut or slit, to define a flexible piece extending from the inner side of the hood member 12 towards the outer end thereof. The flexible piece constitutes a locking arm 15 which is resiliently bendable towards the interior and exterior of the hood member 12. The tip of the locking arm 15 has a wedge-shaped stopping claw 16 that projects outwardly. The upright face on the inner side of the stopping claw 16 is separated from the front face of the flange 13 to the extent of the thickness of the panel 20. It is thus arranged that an edge of the through hole 21 can be inserted and retained between the wall face on the inner side of the stopping claw 16 and the front face of the flange 13.

Since the upper face of the peripheral wall includes the U shaped slit, the hood member 12 extends beyond the front end of the locking arm 15. This portion will be referred to as guard 17. The outer peripheral side faces towards the open end of the hood member 12, including the guard 17, have inwardly inclined faces so that the opening decreases in the direction of the front edge.

Further, the corresponding female connector 30 is formed so as to be insertable into the hood member 12 from the outer side of the panel 20. The female connector 30 supports female terminal fittings so that they face the male terminal fittings.

Figure 3A:
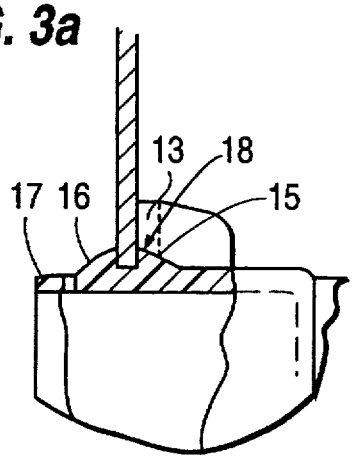
FIG. 3*a* is a part-section corresponding to FIG. 3 and showing a groove of the locking arm.
Figure 4:
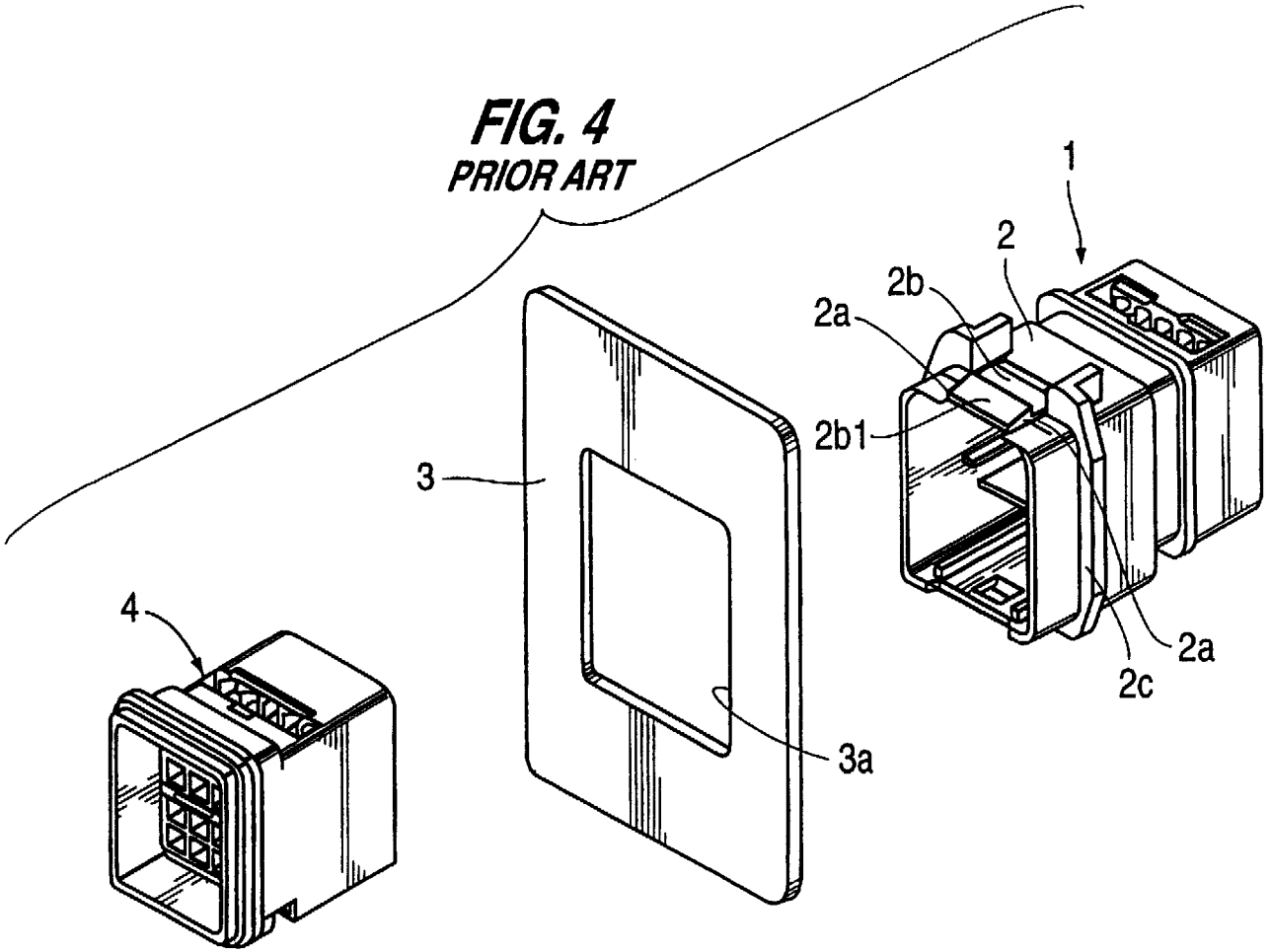
FIG. 4 PRIOR ART
FIG. 4 is a diagrammatic view of a prior art fixed-type connector.
Figure 5:
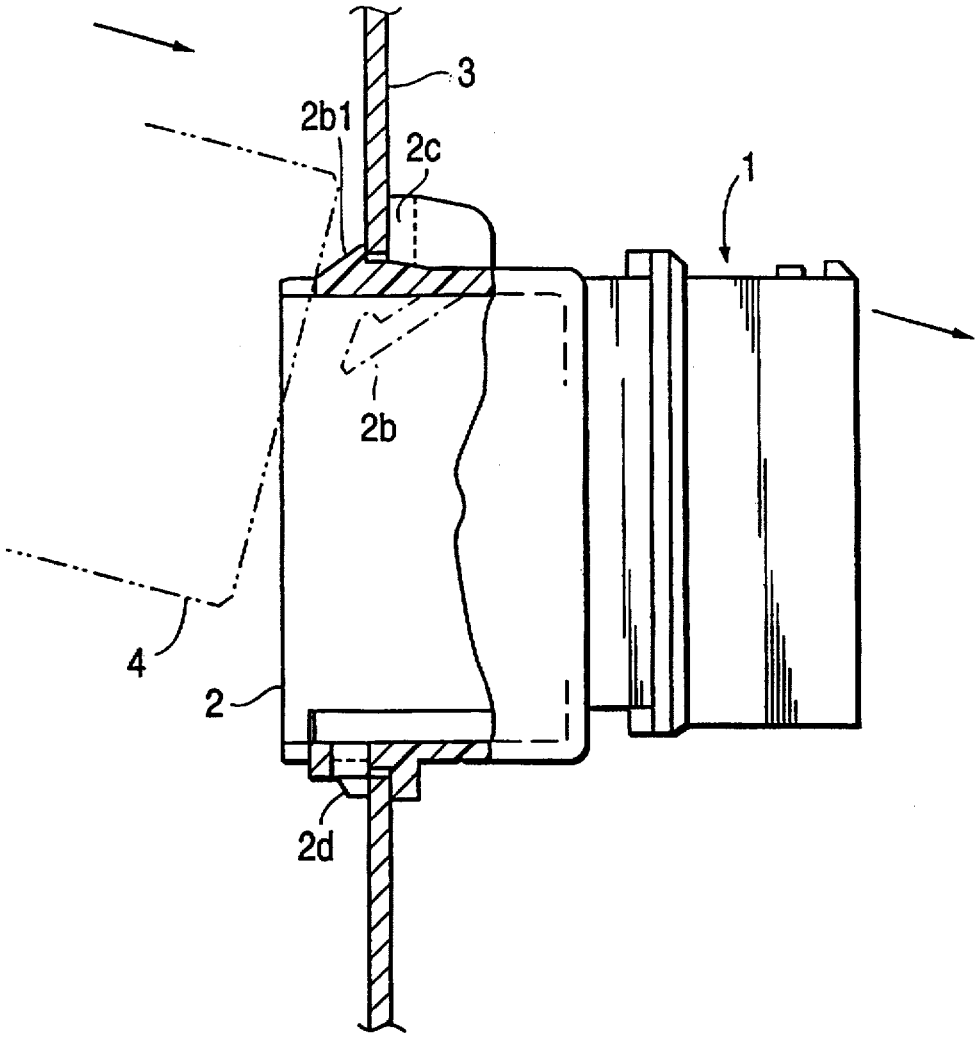
FIG. 5 PRIOR ART
FIG. 5 is a partial cross-section view showing the prior art female connector making contact with the male connector.

In the present embodiment, the flange 13 is formed on the outer side face of the hood member 12 and the edge of the panel 20 is inserted and retained between the flange 13 and the stopping claw 16 of the locking arm 15. However, what is necessary is that a flexible arm bends as it makes contact with the inner side of the through hole 21 and thereby snaps resiliently over the edge of the through hole 21, for retention. Consequently, as illustrated in FIG. 3*a*, a groove 18 may equally be formed on the outer side face of the locking arm 15, the groove clamping the edge of the through hole 21.

Furthermore, the guard 17 protects the entire extent of the locking arm 15. However, this need not be so; the guard 17 can cover the locking arm 15 to an extent sufficient to ensure that the female connector 30 or a hand cannot disturb the locking arm 15.

Apart from this, although the hood member 12 is formed so as to extend around the entire periphery, it is only necessary that a hole-shaped portion be formed so as to allow insertion of the female connector 30. Accordingly, for example, the hood member 12 may equally have a configuration whereby it is partially open so that it extends in three directions from the inner side of the panel through hole 21. Moreover, in the present embodiment, although a stopping projection 14 having a fixed structure is formed on the peripheral wall on the lower face of the hood member 12, this is not necessary as long as at least one further locking arm 15 is provided. Accordingly, the peripheral wall on the lower face may equally have a similar locking arm 15.

The operation of the present embodiment is as follows.

As shown in FIG. 2, in order to attach the male connector 10 to the panel through hole 21 of the panel 20, the male connector 10 is inclined and the lower extremity of the flange 13 is pushed against the inner side face of the panel 20. The edge of the panel through hole 21 is inserted between the flange 13 and the stop projection 14. Then, with this as axis, the upper end of the hood member 12 is pivoted so as to become horizontal (as viewed) and the outer end of the hood member 12 is inserted into the through hole 21. When the upper end of the hood member 12 passes into the through hole 21, since an inclined face is formed on the front end of the guard 17, the inclined face brushes against the edge of the panel through hole 21 and follows an arc described by the hood member 12 as it is inserted. As a result, damage to the stopping claw 16 of the locking arm 15 due to abrupt contact with the edge of the panel through hole 21 is prevented. Furthermore, since the guard 17 is connected to the hood member 12 without partitioning the hood member 12, the strength of the hood member 12 is improved.

When the stopping claw 16 of the locking arm 15 passes through the panel through hole 21, the wedge-shaped stopping claw 16 brushes against the edge of the panel through hole 21, bending the locking arm 15 inwards. After the locking arm 15 crosses over the edge of the panel through hole 21, the locking arm 15 reverts elastically to its original shape and the edge of the panel 20 is clamped securely between the stopping claw 16 and the flange 13.

Once the male connector 10 has been attached to the panel through hole 21 of the panel 20, the female connector 30 is inserted into the hood member 12. At this juncture, as shown in FIG. 3, in the case where the hood member 12 is not visible, there is a possibility of the angular portion of the female connector 30 making contact with the edge of the open end of the hood member 12. However, as shown in the diagram, since the guard 17 covers the front side of the locking arm 15, the locking arm 15 cannot be bent downwards by accident and this prevents the male connector 10 from being separated from the panel 20.

In this way, the hood member 12 of the male connector 10 is inserted and retained in the inner side of the panel through hole 21 of the panel 20. Since the locking arm 15, having the stopping claw 16 at the front end thereof, is provided on the peripheral wall face of the hood member 12, and since the guard 17 is formed in front of the stopping claw 16, even if the female connector 30 is pushed diagonally and makes contact with the guard 17 when the locking arm 15 is retaining and supporting the male connector 10 at the inner side of the panel through hole 21, the locking arm 15 is prevented from being accidentally bent downwards, thereby preventing the connector 10 from coming out.

We claim:

1. A snap-fit electrical connector for retention in an aperture of a panel, the connector having an opening in which a complementary connector is inserted in a first direction, a resilient locking arm having a free end and a locking face, said locking face facing in the first direction for engaging an edge of said aperture to secure the connector to the panel when the connector is inserted into the aperture in a second direction opposite to the first direction, said free end extending in the second direction so as to be accessible in front of the panel and freely depressible at all times, a guard extending in the second direction around the free end of the locking arm to prevent inadvertent contact of the locking arm and release of the connector from the panel, and a projection opposite said locking arm having a locking face for engaging the panel.

2. An electrical connector according to claim 1 wherein said guard surrounds the locking arm.

3. An electrical connector according to claim 2 further including a hood that protrudes through the aperture, said locking arm being co-extensive with said hood, and a portion of said hood constituting said guard.

4. An electrical connector according to claim 3 wherein said hood has an outer edge and is inclined inwardly of the connector in the second direction toward the outer edge thereof.

5. An electrical connector according to claim 3 wherein said hood comprises a substantially continuous ring.

6. An electrical connector according to claim 1 wherein said connector further includes a stop flange engageable with one side of said panel, said locking arm being engageable with the other side of said panel.

7. An electrical connector according to claim 6 and further including a stop member opposite said locking arm, said stop member defining with said stop flange a groove for engagement with the edge of said aperture.

8. An electrical connector according to claim 6 wherein said stop flange is substantially continuous.

9. An electrical connector according to claim 1 wherein said locking arm includes a groove in an outer face thereof to engage the edge of said aperture.

10. An electrical connector according to claim 1 wherein said locking arm and said guard are integrally moulded of plastic material.

11. An electrical connector assembly comprising a panel having an aperture therein and a snap-fit connector for retention in said aperture, the connector having an opening in which a complementary connector is inserted in a first direction, a resilient locking arm having a free end and a locking face, said locking face facing in the first direction for engaging an edge of said aperture to secure the connector to the panel when the connector is inserted into the aperture in a second direction opposite to the first direction, said free end extending in the second direction so as to be accessible in front of the panel and freely depressible at all times, a guard extending in the second direction around the free end of the locking arm to protect the free end of said locking arm from inadvertent contact and release of the connector from the panel due to a member moving in the disengagement direction of said locking arm, and a projection opposite said locking arm having a locking face for engaging the panel.

* * * * *